US008602632B1

(12) United States Patent
Poon

(10) Patent No.: US 8,602,632 B1
(45) Date of Patent: Dec. 10, 2013

(54) REPLACEABLE ELECTRONIC CANDLE WICK

(71) Applicant: Ngatik Poon, Placentia, CA (US)

(72) Inventor: Ngatik Poon, Placentia, CA (US)

( * ) Notice: Subject to any disclaimer, the term of this patent is extended or adjusted under 35 U.S.C. 154(b) by 0 days.

(21) Appl. No.: 13/654,413

(22) Filed: Oct. 18, 2012

Related U.S. Application Data

(60) Provisional application No. 61/552,923, filed on Oct. 28, 2011.

(51) Int. Cl.
*F21V 33/00* (2006.01)

(52) U.S. Cl.
USPC ..... 362/653; 362/810; 362/802; 362/249.02; 362/249.05

(58) Field of Classification Search
USPC ..... 362/810, 802, 646, 652, 655, 249.02, 362/249.05, 311.02
See application file for complete search history.

(56) References Cited

U.S. PATENT DOCUMENTS

2005/0225984 A1* 10/2005 Theobald ..... 362/276
2008/0158863 A1* 7/2008 Tsai ..... 362/183
2010/0124050 A1* 5/2010 Hau et al. ..... 362/183

* cited by examiner

*Primary Examiner* — Laura Tso
(74) *Attorney, Agent, or Firm* — Plager Schack LLP

(57) ABSTRACT

A replaceable electronic candle wick can be easily removed from a setting and accurately mimics a candle flame. The replaceable electronic candle wick comprises a wick assembly that is detachably coupled to a candle base. The wick assembly comprises a base lighting element electrically coupled to an integrated circuit board in the candle base. The wick assembly further comprises a shrink tubing. The candle base further comprises an air pressure sensor electrically coupled to the integrated circuit board. In this manner a user can detach the wick assembly from the candle base to replace the base lighting element and the air pressure sensor can affect a light that effects of the base lighting element via the integrated circuit board.

7 Claims, 4 Drawing Sheets

REPLACEABLE ELECTRONIC CANDLE WICK

CROSS REFERENCE TO RELATED APPLICATIONS

This application claims priority to U.S. Provisional Application 61/552,923 filed on Oct. 28, 2011.

FIELD OF THE INVENTION

This invention relates to devices the parts of which are specially shaped or arranged to resemble a candle or to permit the assembly to be enclosed in a relatively elongated tubular sheath having the appearance of a candle.

BACKGROUND OF THE INVENTION

Inventors have sought to develop artificial candles for many years that simulate actual candles. Many do this, however, replacing the lighting element of these artificial candles evades the skill of the average user. As a result, these expensive candles are thrown away, the prior art includes: U.S. Patent Application 2011/0280008 filed by Bakian; U.S. Pat. No. 7,744,266 issued to Higley; and U.S. Pat. No. 7,828,462 issued to Jensen.

Jensen and Bakian use a single light emitting diode (LED) attached to an integrated circuit board. Higley teaches a replaceable LED socket but does not explain how to mimic a wick. The present invention fills in the holes created by the prior art to teach a LED that is replaceable and can mimic a wick.

BRIEF SUMMARY OF THE INVENTION

A replaceable electronic candle wick can be easily removed from a setting and accurately mimics a candle flame. The replaceable electronic candle wick comprises a wick assembly that is detachably coupled to a candle base. The wick assembly comprises a base lighting element electrically coupled to an integrated circuit board in the candle base. The wick assembly further comprises a shrink tubing. The candle base further comprises an air pressure sensor electrically coupled to the integrated circuit board. In this manner a user can detach the wick assembly from the candle base to replace the base lighting element and the air pressure sensor can affect a light that effects of the base lighting element via the integrated circuit board.

The shrink tubing is further mechanically coupled to a wick lighting element which further comprises a thermal sensor. The wick lighting element and the thermal sensor are electrically coupled to the integrated circuit board such that the wick lighting element works in combination with the base lighting element and the thermal sensor to produce a more realistic candle flame.

There are a number of ways to utilize this technology, for instance: the wick assembly is mechanically coupled to a tea candle body, where the tea candle body further comprises an electronic module. The electronic module comprises a switch to toggle power to the integrated circuit board and a power source for the integrated circuit board. Alternately, the wick assembly is mechanically coupled to a jar candle body, where the jar candle body further comprises an electronic module. The electronic module comprises a switch to toggle power to the integrated circuit board and a power source for the integrated circuit board. Alternately, the wick assembly is mechanically coupled to a wax pillar candle body, where the wax pillar candle body further comprises an electronic module. The electronic module comprises a switch to toggle power to the integrated circuit board and a power source for the integrated circuit board. Alternately, the wick assembly is mechanically coupled to a stick candle body, where the stick candle body further comprises an electronic module. The electronic module comprises a switch to toggle power to the integrated circuit board and a power source for the integrated circuit board.

BRIEF DESCRIPTION OF THE SEVERAL VIEWS OF THE DRAWINGS

Figure 1:
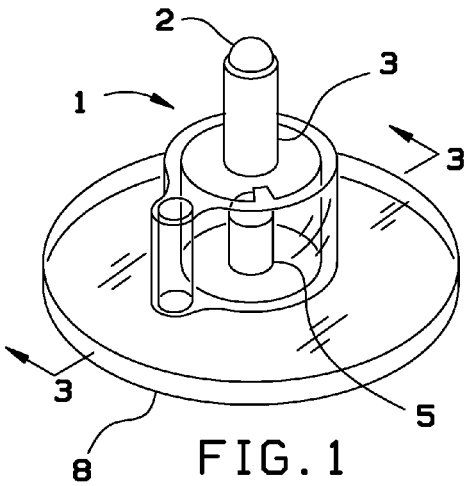

Having thus described the invention in general terms, reference will now be made to the accompanying drawings, which are not necessarily drawn to scale, and wherein:

FIG. 1 is a perspective view of the invention (wick with thermal sensor).

Figure 2:
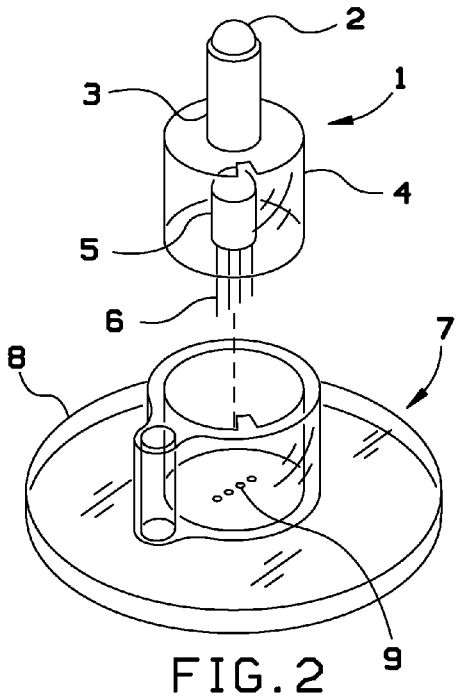

FIG. 2 is an exploded perspective view of the invention (wick with thermal sensor).

Figure 3:
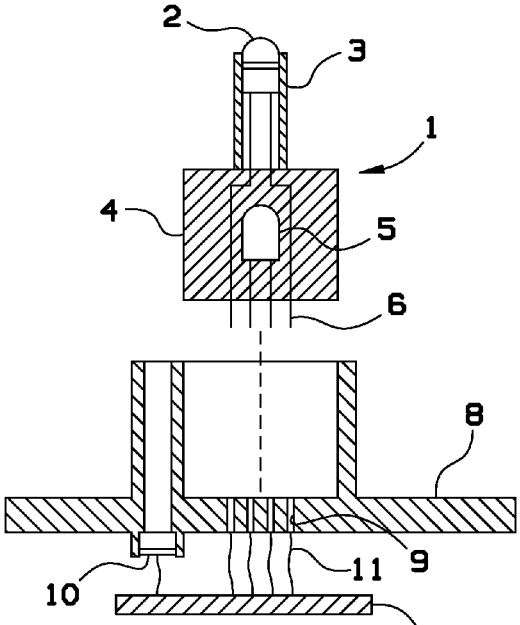

FIG. 3 is an exploded section view of the invention taken along line 3-3 in FIG. 1.

Figure 4:
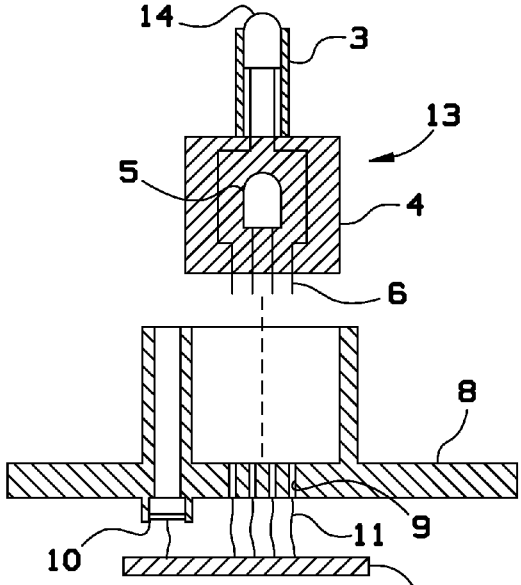

FIG. 4 is an exploded section view of an alternate embodiment of the invention (wick without thermal sensor).

Figure 5:
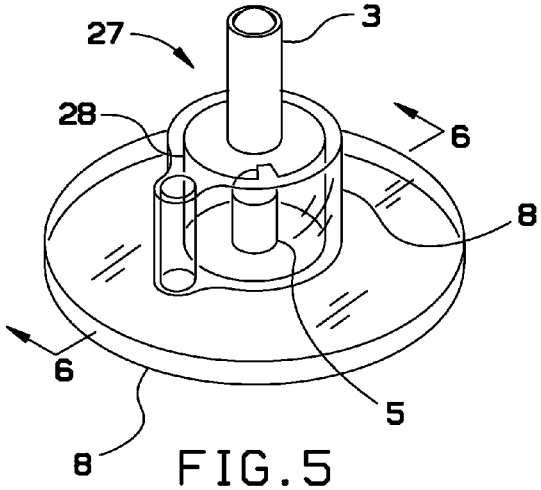

FIG. 5 is a perspective view of a second alternate embodiment of the invention (wick with one led).

Figure 6:
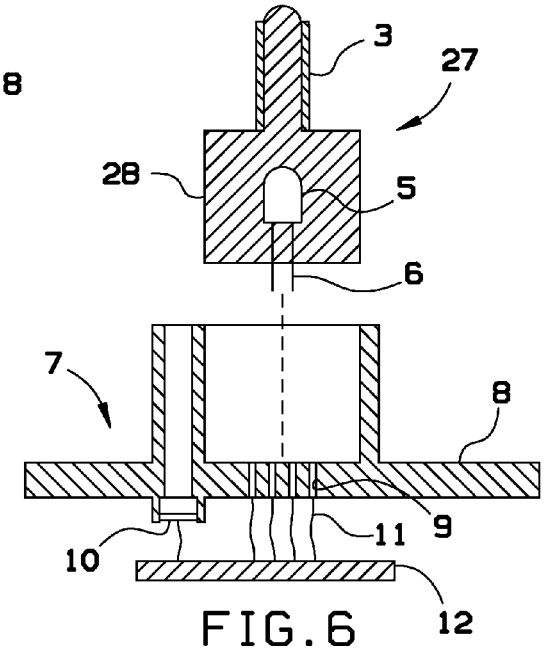

FIG. 6 is an exploded section view of the invention taken along line 6-6 in FIG. 5.

Figure 7:
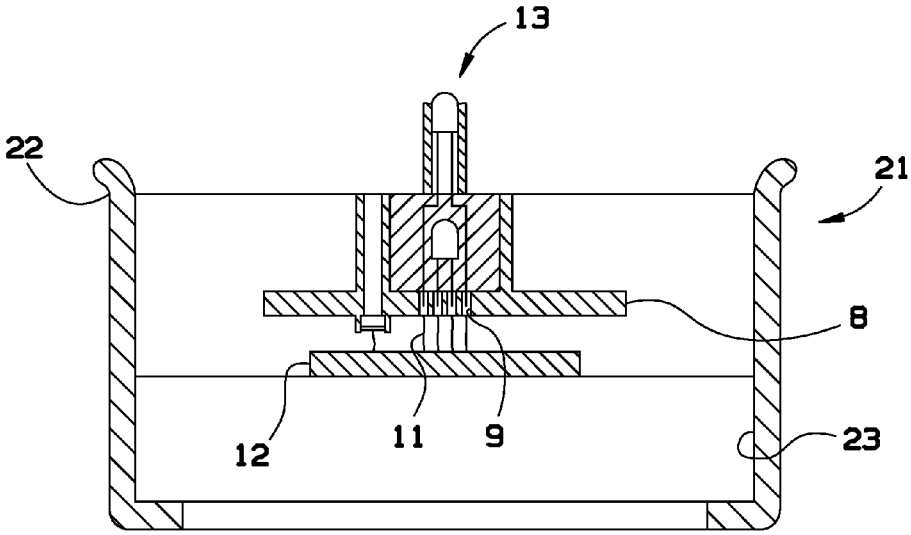

FIG. 7 is a section view of the tea candle configuration of the invention.

Figure 8:
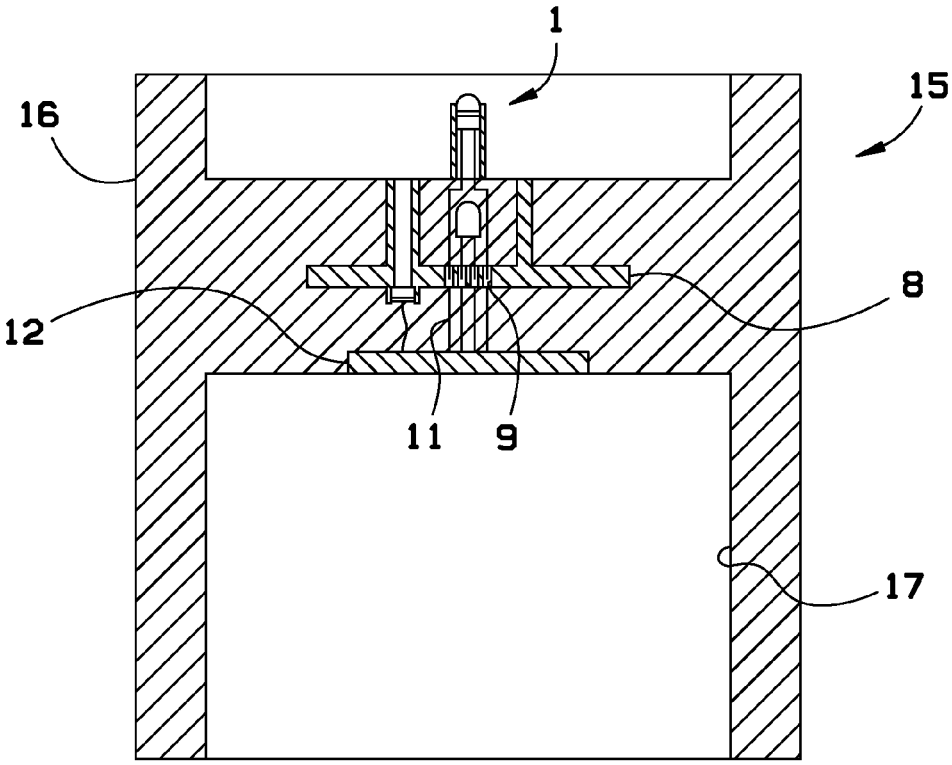

FIG. 8 is a section view of the wax candle body configuration of the invention.

Figure 9:
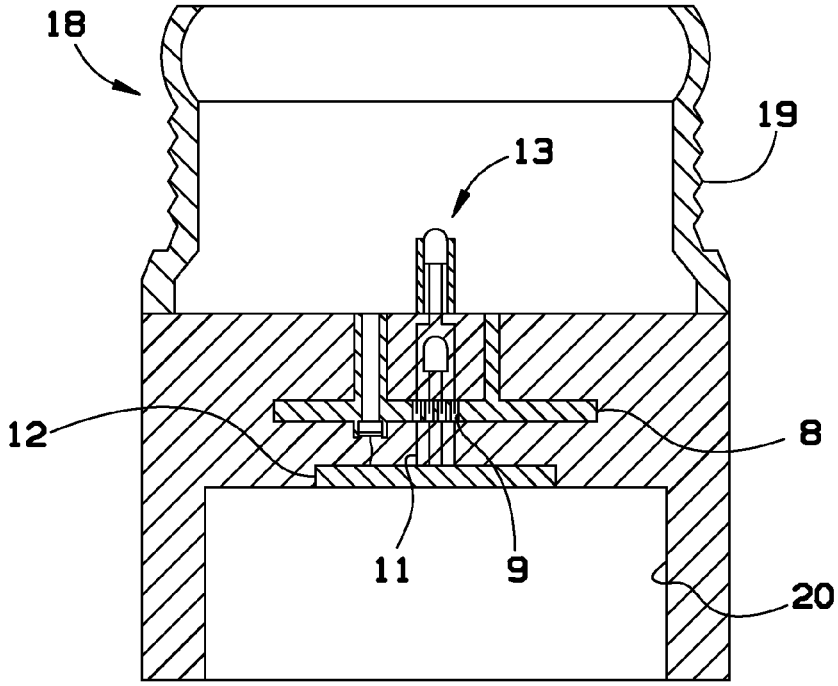

FIG. 9 is a section view of the jar candle configuration of the invention.

Figure 10:
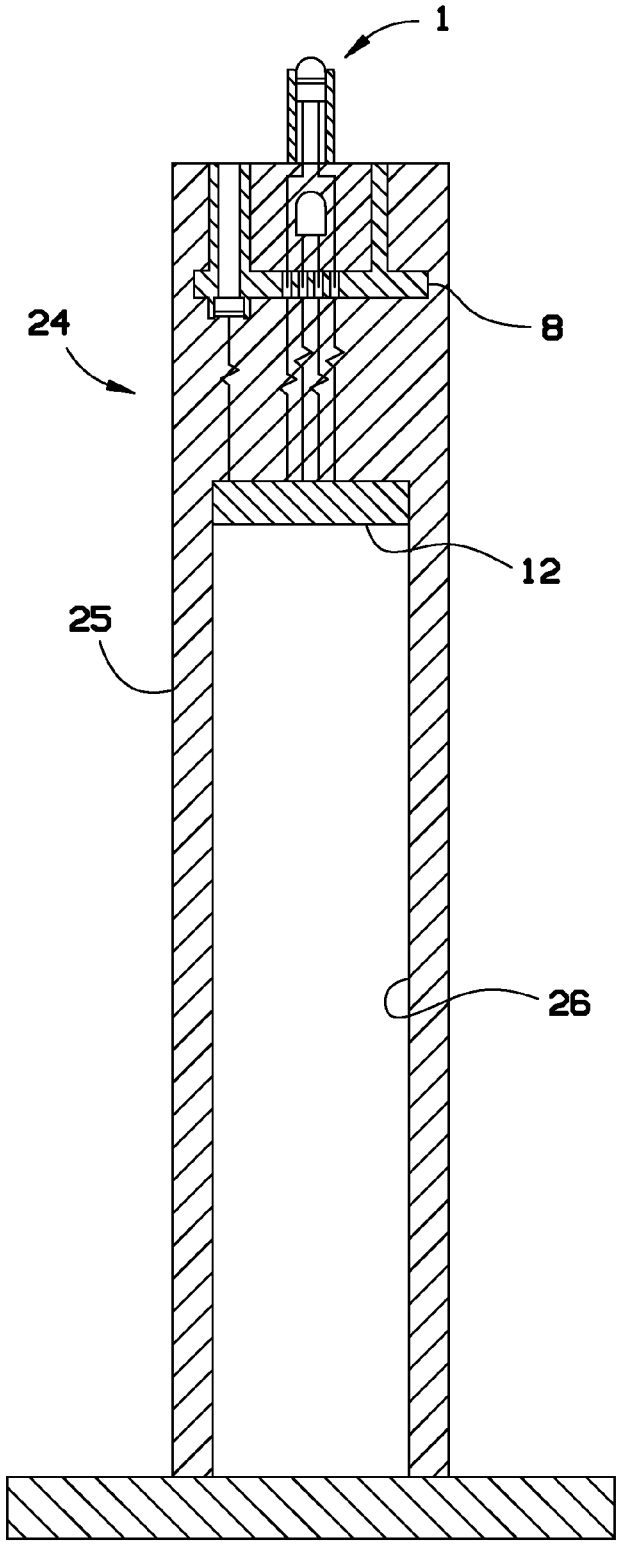

FIG. 10 is a section view of the stick candle configuration of the invention.

DETAILED DESCRIPTION OF THE INVENTION

Embodiments of the present invention overcome many of the obstacles associated with developing a long lasting artificial candle with a replaceable lighting element, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

The present invention teaches that there are at least three different kinds of wick assemblies. Wick assembly 1 is shown in FIG. 1, FIG. 2 and FIG. 3. Alternate wick assembly 13 is shown in FIG. 4. Simplified wick assembly 27 is shown in FIG. 5 and FIG. 6. There are at least four different settings these wick assemblies can be used: Tea candle 21 is shown in FIG. 7. Wax pillar candle 15 is shown in FIG. 8. Jar candle 18 is shown in FIG. 9. Stick candle 24 is shown in FIG. 10.

In each embodiment the wick assembly is powered by batteries. Each wick assembly comprises integrated circuit board 12. Integrated circuit board 12 controls the functions of the wick which includes the timer, light effects, on/off, and/or remote functionality. Some wick assemblies comprise a thermal sensor and each embodiment comprises air pressure sensor 10 that can be turned on by the flame and can be turned off by air pressure. Each wick assembly can also be turned on and off by the switch that connects to integrated circuit board 12.

This wick assembly combined with input from air pressure and or temperature sensors mimics actual candle flame activity. For example if a user blows on the candle, that activity will be picked up by air pressure sensor 10, which will communicate a signal to integrated circuit board 12 which will respond accordingly accurately simulating an actual flame in a manner completely different and more effective than the prior art. As used below, a lighting element is preferably a light emitting diode (LED).

FIG. 1, FIG. 2 and FIG. 3 show perspective views of the replaceable electronic candle wick. Wick assembly 1 comprises wick body 4 mechanically coupled to base lighting element 5. Wick body 4 is further mechanically coupled to shrink tubing 3 which is mechanically coupled to wick lighting element 2.

Candle base 7 comprises wick socket 8 which further comprises pin slots 9. Base lighting element 5 and wick lighting element 2 are mechanically coupled to pins 6. Pins 6 can be mechanically coupled to pin slots 9. This electrically couples base lighting element 5 and wick lighting element 2 with integrated circuit board 12 through wires 11. Integrated circuit board 12 is further electrically coupled to air pressure sensor 10. Air pressure sensor 10 is mechanically coupled to wick socket 8.

In the preferred embodiment wick lighting element 2 is mechanically and electrically coupled to a thermal sensor that is further electrically coupled to integrated circuit board 12 through pins 6 and wires 11. In this manner, integrated circuit board 12 operates such that the wick lighting element 2 works in combination with the base lighting element 5 to produce a more realistic candle flame. However, this does not have to be the only possible construction. In this manner, wick assembly 1 can be easily removed from candle base 7 and provide a replaceable lighting element that can replicate an actual flame as indicated above.

FIG. 4 shows an alternate wick assembly 13 utilizing wick lighting element 14 which does not comprise a thermal sensor. Base lighting element 5 and wick lighting element 14 are mechanically coupled to pins 6. Pins 6 can be mechanically coupled to pin slots 9. This electrically couples base lighting element 5 and wick lighting element 14 with integrated circuit board 12 through wires 11 in a manner similar to the previous embodiment.

FIG. 5 and FIG. 6 show simplified wick assembly 27. Simplified wick assembly 27 comprises transparent wick body 28 mechanically coupled to base lighting element 5. Transparent wick body 28 is further mechanically coupled to shrink tubing 3.

Candle base 7 comprises wick socket 8 which further comprises pin slots 9. Base lighting element is mechanically coupled to pins 6. Pins 6 can be mechanically coupled to pin slots 9. This electrically couples base lighting element 5 with integrated circuit board 12 through wires 11. Integrated circuit board 12 is further electrically coupled to air pressure sensor 10. Air pressure sensor 10 is mechanically coupled to wick socket 8.

FIG. 7 shows alternate wick assembly 13 inside tea candle 21. Tea candle 21 comprises tea candle body 22 which is mechanically coupled to electronic module 23. Electronic module 23 comprises a switch to toggle power to integrated circuit board 12 and a power source for integrated circuit board 12.

FIG. 8 shows wick assembly 1 inside wax pillar candle 15. Wax pillar candle 15 comprises wax pillar candle body 16 which is mechanically coupled to electronic module 17. Electronic module 17 comprises a switch to toggle power to integrated circuit board 12 and a power source for integrated circuit board 12.

FIG. 9 shows alternate wick assembly 13 inside jar candle 18. Jar candle 18 comprises jar candle body 19 which is mechanically coupled to electronic module 20. Electronic module 20 comprises a switch to toggle power to integrated circuit board 12 and a power source for integrated circuit board 12.

FIG. 10 shows wick assembly 1 inside stick candle 24. Stick candle 24 comprises stick candle body 25 which is mechanically coupled to electronic module 26. Electronic module 26 comprises a switch to toggle power to integrated circuit board 12 and a power source for integrated circuit board 12.

That which is claimed:

1. A replaceable electronic candle wick that can be easily removed from a setting and accurately mimics a candle flame, the replaceable electronic candle wick comprising, a wick assembly that is detachably coupled to a candle base, the wick assembly comprises a base lighting element electrically coupled to an integrated circuit board in the candle base; the wick assembly further comprises a shrink tubing;

the candle base further comprises an air pressure sensor electrically coupled to the integrated circuit board;

in this manner a user can detach the wick assembly from the candle base to replace the base lighting element and the air pressure sensor can affect a light effects of the base lighting element via the integrated circuit board.

2. The replaceable electronic candle wick of claim 1, the shrink tubing is further mechanically coupled to a wick lighting element; the wick lighting element is electrically coupled to the integrated circuit board such that the wick lighting element works in combination with the base lighting element to produce a more realistic candle flame.

3. The replaceable electronic candle wick of claim 1, the shrink tubing is further mechanically coupled to a wick lighting element which further comprises a thermal sensor; the wick lighting element and the thermal sensor are electrically coupled to the integrated circuit board such that the wick lighting element works in combination with the base lighting element and the thermal sensor to produce a more realistic candle flame.

4. The replaceable electronic candle wick of claim 1, the shrink tubing is further mechanically coupled to a wick lighting element; the wick lighting element is electrically coupled to the integrated circuit board such that the wick lighting element works in combination with the base lighting element to produce a more realistic candle flame; and the wick assembly is mechanically coupled to a tea candle body, where the tea candle body further comprises an electronic module; the electronic module comprises a switch to toggle power to the integrated circuit board and a power source for the integrated circuit board;

this allows the user to form a tea candle with the wick assembly.

5. The replaceable electronic candle wick of claim 1, the shrink tubing is further mechanically coupled to a wick lighting element; the wick lighting element is electrically coupled to the integrated circuit board such that the wick lighting element works in combination with the base lighting element to produce a more realistic candle flame; and the wick assembly is mechanically coupled to a jar candle body, where the jar candle body further comprises an electronic module; the electronic module comprises a switch to toggle power to the integrated circuit board and a power source for the integrated circuit board;

this allows the user to form a tea candle with the wick assembly.

6. The replaceable electronic candle wick of claim 1, the shrink tubing is further mechanically coupled to a wick lighting element which further comprises a thermal sensor; the wick lighting element and the thermal sensor are electrically coupled to the integrated circuit board such that the wick lighting element works in combination with the base lighting element and the thermal sensor to produce a more realistic candle flame; and the wick assembly is mechanically coupled to a wax pillar candle body, where the wax pillar candle body further comprises an electronic module; the electronic module comprises a switch to toggle power to the integrated circuit board and a power source for the integrated circuit board;

this allows the user to form a wax pillar candle with the wick assembly.

7. The replaceable electronic candle wick of claim 1, the shrink tubing is further mechanically coupled to a wick lighting element which further comprises a thermal sensor; the wick lighting element and the thermal sensor are electrically coupled to the integrated circuit board such that the wick lighting element works in combination with the base lighting element and the thermal sensor to produce a more realistic candle flame; and the wick assembly is mechanically coupled to a stick candle body, where the stick candle body further comprises an electronic module; the electronic module comprises a switch to toggle power to the integrated circuit board and a power source for the integrated circuit board;

this allows the user to form a stick candle with the wick assembly.

* * * * *